US006676539B2

(12) United States Patent
Moriyama et al.

(10) Patent No.: US 6,676,539 B2
(45) Date of Patent: Jan. 13, 2004

(54) THREAD-WOUND GOLF BALL

(75) Inventors: Keiji Moriyama, Kobe (JP); Kazuhiko Isogawa, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/114,263

(22) Filed: Apr. 3, 2002

(65) Prior Publication Data

US 2003/0036444 A1 Feb. 20, 2003

(30) Foreign Application Priority Data

Apr. 3, 2001 (JP) ..... 2001-104751

(51) Int. Cl.[7] ..... A63B 37/06
(52) U.S. Cl. ..... 473/357
(58) Field of Search ..... 473/351, 356, 473/357, 365, 366

(56) References Cited

U.S. PATENT DOCUMENTS 5,704,853 A * 1/1998 Maruko et al. ..... 473/363
5,810,677 A * 9/1998 Maruko et al. ..... 473/357
5,823,888 A * 10/1998 Maruko et al. ..... 473/354
5,848,942 A 12/1998 Kato
5,853,337 A 12/1998 Moriyama et al.

FOREIGN PATENT DOCUMENTS

JP 10-201881 8/1998

* cited by examiner

*Primary Examiner*—Steven Wong
*Assistant Examiner*—Raeann Gordon
(74) *Attorney, Agent, or Firm*—Birch, Stewart, Kolasch & Birch, LLP

(57) ABSTRACT

A thread-wound golf ball 1 producing excellent hit feeling, large carry and superior spin performance is provided having a rubber thread layer 3 formed by winding rubber thread around a center 2, which is further coated with a cover 4. The volume proportion of the rubber thread layer to the golf ball is in the range of 10 to 20%. The difference (A–B) is in the range of 0.5 to 0.7, where A represents deformation (mm) from an initial load of 98N to a final load of 1274N applied on the center, and B represents deformation (mm) from the initial load of 98N to the final load of 1274N applied on a threaded core formed by winding rubber thread around the center. Shore D hardness of the cover is in the range of 50 to 60.

12 Claims, 1 Drawing Sheet

THREAD-WOUND GOLF BALL

BACKGROUND OF THE INVENTION

1. Field of the Invention

The present invention relates to a multi-layered golf ball having a rubber thread layer wound around the center, which attains excellent spin performance and hit feeling and provides a large carry.

2. Description of the Background Art

A multi-layered golf ball with a rubber thread layer has such a structure that rubber thread in a tensioned state is wound around a solid or liquid center to form a rubber thread layer, which is then coated with a cover. The multi-layered golf ball having such a rubber thread layer is superior in hit feeling and controllability to a two-piece golf ball with a solid core coated with a cover. However, the multi-layered golf ball has disadvantages of a high spin rate and a low angle of impact, impeding increase of carry. Thus, amateur players in general tend to prefer two-piece golf balls, which provide large carry, to the multi-layered golf ball having the rubber thread layer.

For instance, techniques of increasing the carry for a thread-wound golf ball with a solid center are described in the following conventional arts. U.S. Pat. No. 5,848,942 discloses a technique in that the center diameter is defined to be in the range of 30 to 38 mm, and the distribution of center hardness, the flexural rigidity of a cover and the like are defined to be within prescribed ranges. Moreover, U.S. Pat. No. 5,853,337 discloses that a center diameter is defined to be in the range of 30 to 38 mm and the difference between deformation under load for the center and that for a ball is defined to be in a prescribed range, while a cover with high hardness is used. Furthermore, Japanese Patent Laying-Open No. 10-201881 discloses that a center diameter is defined to be in the range of 30 to 38 mm and that deformation under load for the center, hardness of the cover and the flexural rigidity are defined to be in prescribed ranges. However, the use of these techniques cannot increase carry while maintaining the superior spin performance of the thread-wound golf ball.

SUMMARY OF THE INVENTION

The present invention is directed to solve a problem of short carry associated with a multi-layered golf ball having a rubber thread layer, and to provide a thread-wound golf ball that attains excellent spin performance and hit feeling and that produces carry equivalent to or larger than that of a two-piece solid golf ball.

According to the present invention, a thread-wound golf ball is provided, in which a center is wound by rubber thread to form a rubber thread layer, which is further coated with a cover. Here, the volume proportion of the rubber thread layer to the entire golf ball is in the range of 10 to 20%. The difference in deformation (A–B) is in the range of 0.5 to 0.7, where A represents deformation (mm) generated in the transition from an initial load of 98N to a final load of 1274N applied on the center, and B represents deformation (mm) generated in the transition from the initial load of 98N to the final load of 1274N applied on a thread-wound core formed by winding rubber thread around the center. The cover has Shore D hardness between 50 and 60.

Preferably, the thickness of the cover is in the range of 1.0 to 2.0 mm, and deformation (mm) A generated in the transition from the initial load of 98N to the final load of 1274N applied on the center is in the range of 3.3 to 3.9. More preferably, deformation (mm) B generated in the transition from the initial load of 98N to the final load of 1274N applied on the thread-wound core described above is in the range of 2.7 to 3.4 mm.

The foregoing and other objects, features, aspects and advantages of the present invention will become more apparent from the following detailed description of the present invention when taken in conjunction with the accompanying drawing.

DESCRIPTION OF THE PREFERRED EMBODIMENTS

Figure 1:
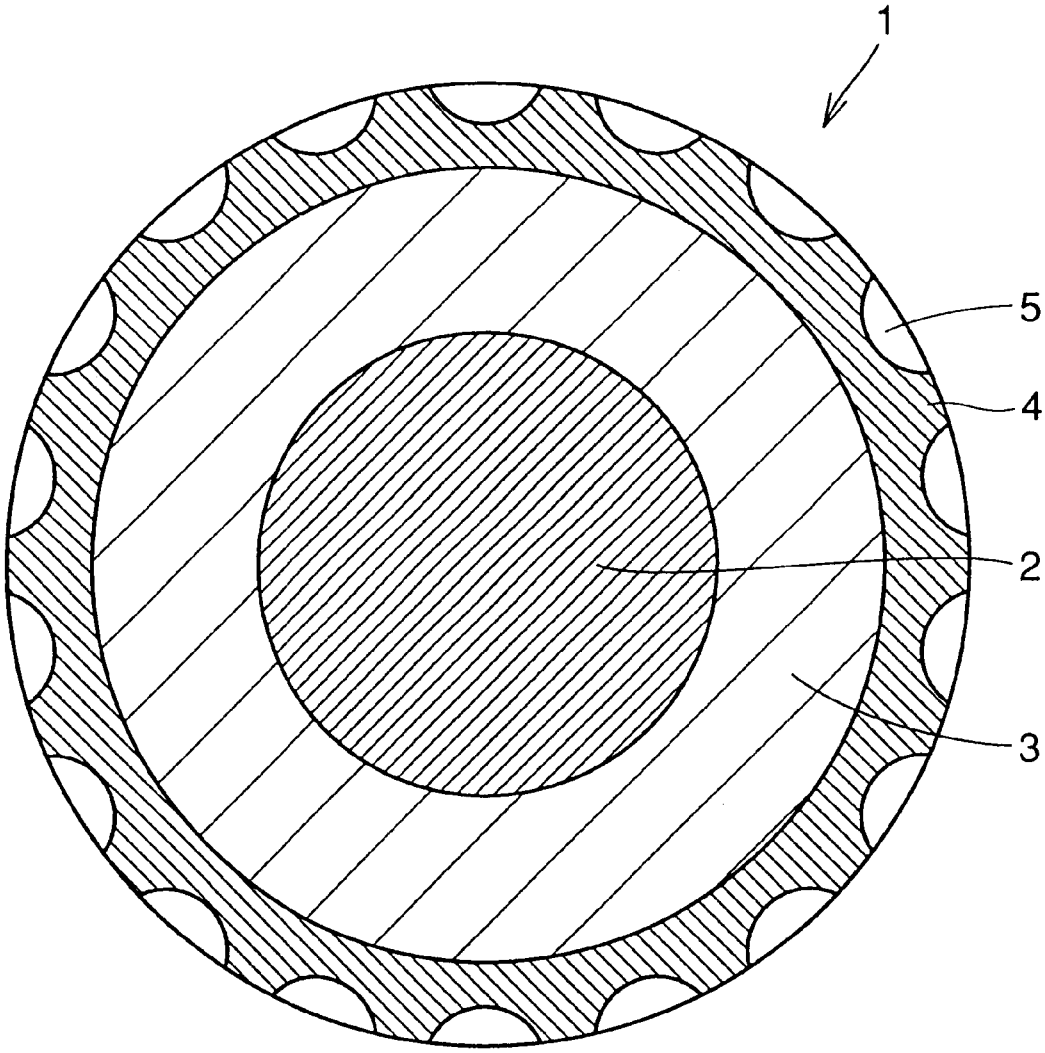
FIG. 1 shows a section view of a golf ball according to the present invention.

The present invention is to improve resilience and initial condition of a golf ball while maintaining its spin performance, and to attain a large carry, by providing a balanced relation between the proportion of the volume of a rubber thread layer made of rubber thread wound around a solid center to the volume of the entire golf ball, and tension of the wound rubber thread, the tension being indicated herein by the difference between deformation under load for the center and that for the thread-wound core. According to the present invention, the volume proportion of the rubber thread layer to the golf ball is between 10 and 20%.

The spin rate in the thread-wound golf ball can be adjusted by defining the volume proportion of the rubber thread layer to be in the range as described earlier. The present invention is characterized in that the spin rate can be reduced in hitting the golf ball with a high-head-speed club. If the volume proportion of the rubber thread layer is less than 10%, the spin performance specified for the thread-wound golf ball when hit with a short iron cannot be maintained. On the contrary, if the volume proportion of the rubber thread layer is more than 20%, the spin rate when hit with a high-head-speed club cannot be reduced, providing insufficient carry. The volume proportion of the rubber thread layer is preferably in the range of 12.0 to 19.5%, and more preferably 12.0 to 15.0%. Here, the volume of the rubber thread layer is defined as the volume of a region surrounded by the outer surface of the center and an interface between the rubber thread layer and the cover. It is noted that, when the cover penetrates into the rubber thread layer, the interface between the rubber thread layer and the cover means a virtual line forming the outermost surface of the rubber thread layer.

According to the present invention, the difference in deformation (A–B) is in the range of 0.5 to 0.7, where A represents deformation (mm) generated in the transition from the initial load of 98N to the final load of 1274N applied on the center, and B represents deformation (mm) generated in the transition from the initial load of 98N to the final load of 1274N applied on the thread-wound core formed by winding rubber thread around the center. Such a range of difference in deformation can increase tension of the rubber thread layer with a smaller number of rubber thread layers, while reducing spin rate when hit with a high-head-speed club, and improving resilience of the golf ball, so that a large carry can be obtained.

If the difference in deformation (A–B) is less than 0.5, the resilience of the golf ball cannot be improved. If, on the other hand, the difference in deformation (A–B) is more than 0.7, the rubber thread is overloaded because of the reduced number of rubber thread layers, degrading durability of the golf ball itself. More preferably, the difference in deformation (A–B) is in the range of 0.5 to 0.6.

According to the present invention, preferably, deformation (mm) A generated in the transition from the initial load of 98N to the final load of 1274N applied on the center is smaller than that in a conventional golf ball, i.e., in the range of 3.3 to 3.9 mm. If deformation A for the center is smaller than 3.3 mm, the center is hardened and the spin rate is increased, while the hit feeling becomes hard, approaching that for a two-piece solid ball. If, on the other hand, the deformation for the center is larger than 3.9 mm, though the hit feeling is softened, no sufficient resilience of the golf ball can be obtained and no increase in carry can be expected.

According to the present invention, deformation B generated in the transition from the initial load of 98N to the final load of 1274N applied on the thread-wound core is preferably in the range of 2.7 to 3.4 mm, and more preferably 2.9 to 3.2 mm. When deformation B is less than 2.7 mm, hit feeling becomes hard. On the contrary, when it exceeds 3.4 mm, resilience is insufficient and thus the carry tends to be short.

According to the present invention, the center preferably has a diameter in the range between 36.5 and 38.5 mm. If the center diameter is smaller than 36.5 mm, the spin rate increases while a launch angle has a value approximately equal to that of the conventional golf ball, impeding increase of the carry. If, on the other hand, the center diameter is larger than 38.5 mm, the rubber thread layer becomes so thin that winding of the rubber thread is terminated before tension is applied to the rubber thread. Thus, appropriate hardness cannot be provided for the golf ball, and no increase in the carry can be expected.

Though high cis polybutadiene is preferable for a rubber component for the center, high cis polybutadiene blended with natural rubber, polyisoprene rubber, styrene butadiene and the like may also be used.

Metal salt of α,β-unsaturated carboxylic acid is blended into the rubber composition for the center as a co-crosslinking agent. For example, sodium salt, zinc salt, magnesium salt or the like of acrylic acid and methacrylic acid is used as the metal salt of α,β-unsaturated carboxylic acid. The blending amount of the metal salt of α,β-unsaturated carboxylic acid is preferably 5 to 40 parts by weight, and more preferably 10 to 35 parts by weight, for 100 parts by weight of the rubber component. When the blending amount of the metal salt of α,β-unsaturated carboxylic acid is less than 5 parts by weight, the center becomes so soft that no improvement in performance can be seen compared to the conventional golf ball. On the other hand, when the blending amount of the metal salt of α,β-unsaturated carboxylic acid is more than 40 parts by weight, the center becomes so hard that the golf ball may provide inferior hit feeling.

As the rubber composition for the center, an organic peroxide, for example, dicumyl peroxide, 1,1-bis(t-butyl peroxy)-3,3,5-trimethylcyclohexane, 2,5-dimethyl-2,5-di(t-butyl peroxy)hexane, di-t-butyl peroxide or the like is used as a crosslinking initiator. Preferably, the blending amount of such organic peroxide is, though not particularly limited thereto, 0.5 to 3 parts by weight for 100 parts by weight of the rubber component.

Moreover, the rubber composition for the center may be blended with a filler, for example, zinc oxide, barium sulfate, calcium carbonate or the like. The blending amount of the filler is, preferably, though not particularly limited thereto, 5 to 40 parts by weight for 100 parts by weight of the rubber component.

The center is formed by vulcanizing the rubber composition for the center into a spherical shape. In the vulcanization, press forming may generally be adopted. The vulcanization by the press forming is performed by filling the rubber composition for the center into a mold and heated normally at 140 to 180° C. under pressure for 10 to 60 minutes. The heating at the vulcanization forming may be performed in one stage or in two separate stages.

In the present invention, the thread-wound core is obtained by winding tensioned rubber thread around the center. For the rubber thread to be used to form a rubber thread layer, a conventionally-used rubber composition may be utilized. For instance, the rubber thread can be obtained by vulcanizing a rubber composition consisting of natural rubber or a mixture of natural rubber and polyisoprene, which is blended with sulfide, vulcanization assistant, vulcanization accelerator, antioxidant and the like.

Preferably, the thread-wound core has a diameter between 38.8 and 40.8 mm, and more preferably between 39.6 and 40.4 mm. If the diameter is less than 38.8 mm, the cover is made thicker, increasing spin rate and reducing carry, when combined with the soft center described earlier. If, on the other hand, the diameter exceeds 40.8 mm, the cover is made thinner, lowering spin performance with a short iron.

In the present invention, the cover has Shore D hardness between 50 and 60. If the Shore D hardness of the cover is higher than 60, the hardness of the golf ball is increased, deteriorating hit feeling as well as spin performance. On the contrary, if the cover has Shore D hardness lower than 50, the spin rate increases when hit with high head speed, resulting in shorter carry. The Shore D hardness is preferably in the range of 50 to 58, more preferably 50 to 55, and more particularly 51 to 54.

In the present invention, the cover preferably has a thickness of 1.0 to 2.0 mm. The cover thickness of less than 1.0 mm would deteriorate spin performance. If, on the other hand, the thickness of the cover is more than 2.0 mm, though the spin performance is improved for an short iron, resilience is deteriorated because of the low hardness of the cover as described above, preventing increase of carry.

The cover is mainly made of ionomer resin. Examples of the ionomer resin are, when listed by trade names, Hi-milan 1605 (Na), Hi-milan 1707 (Na), Hi-milan AM7318 (Na), Hi-milan 1705 (Zn), Hi-milan 1706 (Zn), Hi-milan 1652 (Zn), Hi-milan AM7315 (Zn), Hi-milan AM7317 (Zn), Hi-milan MK7320 (K), Hi-milan AM7311 (Mg), Hi-milan 1856 (Na), Hi-milan 1855 (Zn), Hi-milan AM7316 (Zn) and the like, which are commercially available from Mitsui-DePont Polychemical Co, Ltd. Moreover, ionomer resin commercially available from DuPont Co, Ltd. (U.S.A.) include Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li), Surlyn AD8265 (Na), Surlyn AD8269 (Na), and the like. Furthermore, ionomer resin commercially available from Exxon Corp. include IOTEC 7010 (Zn), IOTEC 8000 (Na) and the like. Such ionomer resin may be used solely or as a mixture of two or more kinds. It is noted that Na, Zn, Li, K, Mg etc. indicated in the parentheses following the trade names of ionomer resin represent their neutralizing metal ion types.

Besides the resin component such as the ionomer resin listed above, if required, inorganic filler such as zinc oxide and barium sulfate, and titanium dioxide or the like used as pigment for coloring may also be added to the composition for cover.

A conventional method may be used for coating a cover on a thread-wound core consisting of the center and a rubber thread layer formed by winding rubber thread around the center. For instance, the composition for cover is pre-formed into a hemispherical half shell, and two pieces of the half shells are used to envelop a base core, which is then press-formed at 120 to 180° C. for 1 to 20 minutes.

Dimples may be formed as required on the surface of the golf ball at molding of the cover, and paint finish, stamp or the like may also be provided as required after molding of the cover.

The diameter of the thread-wound golf ball according to the present invention is set generally in the range of 42.67 to 42.93 mm, and more preferably in the range of 42.67 to 42.82 mm. Deformation (mm) C in the transition from the initial load of 98N to the final load of 1274N applied on a golf ball is preferably in the range of 2.6 mm to 3.3 mm, and more preferably in the range of 2.8 mm to 3.1 mm. Deformation C under 2.6 mm hardens shot feeling, whereas that above 3.3 mm lowers resilience.

When the values of deformation A for the center, deformation B for the thread-wound core and deformation C for the golf ball described above assume A>B>C, the entire golf ball presents hard outside and soft inside in the distribution of compressive hardness for the entire golf ball. Therefore, when the golf ball is hit with a club producing high head speed, the ball can be launched at a low spin rate, allowing increase of carry. Further, the difference between deformation B and deformation C is preferably in the range of $0<(B-C)<0.3$, and more preferably in the range of $0<(B-C)<0.2$. If the difference assumes a negative value, the spin rate increases and the carry tends to decrease when the ball is hit with high head speed. On the contrary, if it exceeds 0.3, the spin performance with a short iron is deteriorated.

A general structure of the thread-wound golf ball of the present invention will be described with reference to the drawing. FIG. 1 is a section view schematically illustrating an example of a golf ball of the present invention. In FIG. 1, a golf ball is denoted by the reference number 1, a center is denoted by 2, a rubber thread layer is denoted by 3, a cover is denoted by 4, and dimples are denoted by 5. Rubber thread layer 3 is formed by winding rubber thread in a drawn state around center 2, and constitutes a thread-wound core together with center 2. Cover 4 provides a coating around rubber thread layer 3. The arrangement and number of dimples 5 are determined as required or to conform to a desired property.

EXAMPLES

The present invention will specifically be described below based on examples.

Examples 1–4, Comparison Examples 1–4

The composition as indicated in Table 1 was used to control rubber compositions for center 1 to 8. The blending amount of each component in Table 1 is indicated by parts by weight. A mold for the center was filled with a rubber composition for center, which was vulcanized under pressure, to fabricate the center. The vulcanization was performed at 160° C. for 23 minutes. The diameter and deformation of the center are indicated in Table 4. The deformation of the center indicated in Table 4 represents measured deformation that was generated in the transition from the initial load of 98 N to the final load of 1274N applied on the center.

TABLE 1

| Composition No. (parts by weight) and Molding Condition for Center | | | | | | | | |
|---|---|---|---|---|---|---|---|---|
| Composition/molding condition | 1 | 2 | 3 | 4 | 5 | 6 | 7 | 8 |
| BR18*1) | 100 | 100 | 100 | 100 | 100 | 100 | 100 | 100 |
| Zinc acrylate | 28 | 28 | 28 | 28 | 28 | 28 | 28 | 28 |
| Zinc oxide | 10.2 | 10.2 | 10.2 | 7.5 | 14.7 | 10.2 | 10.2 | 10.2 |
| Barium sulfate | 20.8 | 20.8 | 20.8 | 20.8 | 20.8 | 20.8 | 20.8 | 20.8 |
| Diphenyl disulfide | 0.5 | 0.5 | 0.5 | 0.5 | 0.5 | 0.5 | 0.5 | 0.5 |
| Dicumyl peroxide | 0.9 | 0.9 | 0.9 | 0.9 | 0.9 | 0.9 | 0.9 | 0.9 |
| Molding condition | | | | | | | | |
| Temperature (° C.) | 160 | 160 | 160 | 160 | 160 | 160 | 160 | 160 |
| Time (min) | 23 | 23 | 23 | 23 | 23 | 23 | 23 | 23 |

*1)cis-1,4-polybutadiene from JSR Corporation (cis content of 96% or more)

As a rubber component, rubber thread having a width of 1.5 mm and a thickness of 0.5 mm, formed by vulcanizing the rubber composition of natural rubber and low cis isoprene rubber that are blended at 40/60 parts by weight respectively, was wound around the center, to produce a thread-wound core with the diameter and deformation indicated in Table 4.

Half shells for the cover were formed by injection molding from the composition for cover as indicated in Tables 2 and 3. Then, two pieces of such half shells were used to envelop the thread-wound core, which was press-formed in a mold for golf balls at 150° C. for two minutes and coated with a cover, and thereafter cooling water was introduced to lower the temperature to 20° C. Subsequently, paint was applied on the surface of the cover to produce a golf ball with an outer diameter of 42.75 mm.

TABLE 2

| Brand | Metal type | Hardness (Shore D) | Components | Manufacturer |
|---|---|---|---|---|
| SURLYN 9945 | Zn | 59 | ionomer of binary copolymer; Zn-neutralized ethylene/methacrylate | Mitsu-DuPont Polychemical Co., Ltd. |
| SURLYN 8945 | Na | 61 | ionomer of binary copolymer; Na-neutralized ethylene/methacrylate | Mitsu-DuPont Polychemical Co., Ltd. |
| EPOFRIEND A1010 | — | 70*1) | epoxy-modified styrene/butadiene/styrene; epoxidated SBS | Daicel Chemical Industries, Ltd. |
| SEPTON HG252 | — | 80*1) | hydrogenated, polystyrene block-isoprene/ butadiene random polymer block copolymer with end coupled with OH radical | Kuraray Co., Ltd. |

*1)JIS-A hardness

TABLE 3

| | Cover Composition (parts by weight) | | | | | | | |
|---|---|---|---|---|---|---|---|---|
| Composition No. | 1 | 2 | 3 | 4 | 5 | 6 | 7 | 8 |
| SURLYN 8945 | 30 | 35 | 35 | 35 | 30 | 25 | 30 | 50 |
| SURLYN 9945 | 30 | 35 | 35 | 35 | 30 | 25 | 30 | 50 |
| SEPTON HG252 | 30 | 23 | 23 | 23 | 30 | 35 | 30 | — |
| EPOFRIEND A1010 | 10 | 7 | 7 | 7 | 10 | 15 | 10 | — |
| Titanium oxide | 4 | 4 | 4 | 4 | 4 | 4 | 4 | 4 |
| SANOL LS770*1) | 0.2 | 0.2 | 0.2 | 0.2 | 0.2 | 0.2 | 0.2 | 0.2 |

*1)SANOL LS770: antioxidant from Sankyo Co., Ltd.

The golf ball was evaluated as follows.

(1) Flight Performance

<Hitting Test with Driver >

A metal head driver (XXIO W#1, with a loft angle of eight degrees and X shaft, manufactured by Sumitomo Rubber Industries Ltd.) was attached to a swing robot from Golf Laboratory Co., Ltd., and used to hit a golf ball with head speed set at 50 m/sec, to measure the launch angle immediately after launch and the back spin rate immediately after launch, and total carry. The measurement was performed 12 times per ball, and the average was calculated for each golf ball and presented as a measurement result.

<Hitting Test with Sand Wedge >

A sand wedge (DP-601/SW manufactured by Sumitomo Rubber Industries Ltd.) was attached to a swing robot from Golf Laboratory Co., Ltd., and used to hit each golf ball with head speed set at 21 m/sec, to measure the back spin rate immediately after launch. The measurement was performed 12 times per ball, and the average was calculated for each golf ball and presented as a measurement result.

TABLE 4

| | | | Examples | | | | Comparison Examples | | | |
|---|---|---|---|---|---|---|---|---|---|---|
| | | | 1 | 2 | 3 | 4 | 1 | 2 | 3 | 4 |
| Specification of golf ball | center | diameter (mm) | 37 | 37 | 37 | 38.3 | 35.8 | 37 | 37 | 37 |
| | | deformation A (mm) | 3.6 | 3.6 | 3.6 | 3.7 | 3.6 | 3.6 | 3.6 | 3.6 |
| | | composition No. | 1 | 2 | 3 | 4 | 5 | 6 | 7 | 8 |
| | thread-wound core | thread wound core diameter (mm) | 39.6 | 39.6 | 40.4 | 40.4 | 39.6 | 39.6 | 39.6 | 40.4 |
| | | rubber thread layer thickness (mm) | 1.3 | 1.3 | 1.7 | 1.0 | 1.9 | 1.3 | 1.3 | 1.7 |
| | | (rubber thread layer volume)/(ball volume) × 100 | 14.3 | 14.3 | 19.3 | 12.2 | 20.5 | 14.3 | 14.3 | 19.3 |
| | | deformation B (mm) | 3.0 | 3.1 | 3.1 | 3.1 | 3.0 | 3.0 | 3.3 | 3.1 |
| | cover | thickness (mm) | 1.6 | 1.6 | 1.2 | 1.2 | 1.6 | 1.6 | 1.6 | 1.2 |
| | | hardness (Shore D) | 51 | 54 | 54 | 54 | 51 | 46 | 51 | 65 |
| | | composition No. | 1 | 2 | 3 | 4 | 5 | 6 | 7 | 8 |
| | ball | diameter | 42.75 | 42.75 | 42.75 | 42.75 | 42.75 | 42.75 | 42.75 | 42.75 |
| | | ball deformation C (mm) | 2.9 | 2.9 | 3.0 | 3.0 | 2.9 | 3.0 | 3.2 | 2.9 |
| | | deformation (A-B) | 0.6 | 0.5 | 0.5 | 0.6 | 0.6 | 0.6 | 0.3 | 0.5 |
| | | deformation (B-C) | 0.1 | 0.2 | 0.1 | 0.1 | 0.1 | 0 | 0.1 | 0.2 |

TABLE 4-continued

| | | | Examples | | | | Comparison Examples | | | |
|---|---|---|---|---|---|---|---|---|---|---|
| | | | 1 | 2 | 3 | 4 | 1 | 2 | 3 | 4 |
| Performance | flight test W#1 50 m/s | launch angle (°) | 8.3 | 8.3 | 8.2 | 8.5 | 8 | 7.8 | 8.3 | 8.2 |
| | | spin rate (rpm) | 2790 | 2760 | 2850 | 2530 | 2950 | 3180 | 2750 | 2780 |
| | | total carry (m) | 256.3 | 257.4 | 253.7 | 256.4 | 251.3 | 249.4 | 251.9 | 258.8 |
| | flight test SW 21 m/s | spin rate (rpm) | 6880 | 6810 | 6970 | 6850 | 6900 | 7250 | 6680 | 5800 |

In Comparison Example 1, the volume rate of the rubber thread layer is high, i.e. 20.5%, so that the launch angle is low, resulting in high spin rate and low carry when hit with high head speed. In Comparison Example 2, the Shore D hardness of the cover is low, i.e. 46, resulting in insufficient carry. In Comparison Example 3, the difference in deformation (A–B) is small, i.e. 0.3, which impedes large carry. In Comparison Example 4, the Shore D hardness of the cover is high, i.e. 65, deteriorating the spin performance with a short iron. Any one of Examples 1 to 4 in the present invention has a higher spin rate when hit with the sand wedge, and a superior spin performance with the short iron. Moreover, when hit with a driver which produces high head speed, low spin rate and hence high carry can be obtained.

According to the present invention, in a thread-wound golf ball, the volume proportion of a rubber thread layer in the golf ball is defined to be in a certain range, and the difference between deformation under load for the center and that for the thread-wound core is also defined to be in a prescribed range, so that hit feeling and spin performance with a short iron can be maintained while high carry can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread-wound golf ball having a rubber thread layer formed by winding rubber thread around a center, the rubber thread layer further being coated with a cover, wherein a volume proportion of said rubber thread layer to the golf ball is in the range of 10 to 20%, a difference between A and B (A–B) is in the range of 0.5 to 0.7, where A represents deformation (mm) generated in a transition from an initial load of 98N to a final load of 1274N applied on said center, and B represents deformation (mm) generated in a transition from an initial load of 98N to a final load of 1274N applied on a thread-wound core formed by winding rubber thread around said center, and a Shore D hardness of said cover is in the range of 50 to 60 wherein the thread-wound core deformation B is greater than a deformation (mm) C in a transition from an initial load of 98N to a final load of 1274N applied on the golf ball.

2. The thread-wound golf ball according to claim 1, wherein said cover has a thickness between 1.0 and 2.0 mm, and said deformation (mm) A generated in the transition from the initial load of 98N to the final load of 1274N applied on said center is in the range of 3.3 to 3.9 mm.

3. The thread-wound golf ball according to claim 1, wherein said deformation (mm) B generated in the transition from the initial load of 98N to the final load of 1274N applied on said thread-wound core is in the range of 2.7 to 3.4 mm.

4. The thread-wound golf ball according to claim 2, wherein said deformation (mm) B generated in the transition from the initial load of 98N to the final load of 1274N applied on said thread-wound core is in the range of 2.7 to 3.4 mm.

5. The thread-wound golf ball according to claim 2, wherein the thread-wound core deformation B is greater than a deformation (mm) C in a transition from an initial load of 98N to a final load of 1274N applied on the golf ball.

6. The thread-wound golf ball according to claim 1, wherein the volume proportion of said rubber thread layer to the golf ball is in the range of 12 to 15%.

7. The thread-wound golf ball according to claim 1, wherein the difference between A and B (A–B) is in the range of 0.5 to 0.6.

8. The thread-wound golf ball according to claim 3, wherein said deformation B is in the range of 2.9 to 3.2 mm.

9. The thread-wound golf ball according to claim 1, wherein the Shore D hardness of said cover is in the range of 50 to 58.

10. The thread-wound golf ball according to claim 1, wherein the Shore D hardness of said cover is in the range of 51 to 54.

11. The thread-wound golf ball according to claim 1, wherein the difference between said deformation B and said deformation C is in the range of greater than zero and less than 0.3.

12. The thread-wound golf ball according to claim 1, wherein the difference between said deformation B and said deformation C is in the range of greater than zero and less than 0.2.

* * * * *